US007838752B2

(12) United States Patent
LaMarra

(10) Patent No.: US 7,838,752 B2
(45) Date of Patent: Nov. 23, 2010

(54) GUITAR BRIDGE WITH A SUSTAIN BLOCK AND TUNE-O-MATIC SADDLES

(76) Inventor: Frank LaMarra, 7305 Creekview, West Bloomfield, MI (US) 48322

( * ) Notice: Subject to any disclaimer, the term of this patent is extended or adjusted under 35 U.S.C. 154(b) by 394 days.

(21) Appl. No.: 11/956,780

(22) Filed: Dec. 14, 2007

(65) Prior Publication Data

US 2008/0148919 A1 Jun. 26, 2008

Related U.S. Application Data

(63) Continuation-in-part of application No. 11/333,734, filed on Jan. 17, 2006, now Pat. No. 7,488,878.

(51) Int. Cl.
*G10D 3/00* (2006.01)

(52) U.S. Cl. ..... 84/313; 84/298

(58) Field of Classification Search ..... 84/313, 84/298

See application file for complete search history.

(56) References Cited

U.S. PATENT DOCUMENTS

| | | | | |
|---|---|---|---|---|
| 3,237,502 | A | 3/1966 | Moseley | |
| 3,290,980 | A | 12/1966 | Fender | |
| 4,026,181 | A | 5/1977 | Barcus et al. | |
| 4,031,799 | A * | 6/1977 | Fender | 84/307 |
| 4,248,126 | A | 2/1981 | Lieber | |
| 4,383,466 | A * | 5/1983 | Shibuya | 84/313 |
| 4,491,051 | A | 1/1985 | Barcus | |
| 4,541,320 | A | 9/1985 | Sciuto | |
| 4,632,005 | A | 12/1986 | Steinberger | |
| 4,633,754 | A | 1/1987 | Chapman | |
| 4,681,010 | A * | 7/1987 | Wilkinson | 84/298 |
| 4,858,509 | A | 8/1989 | Marshall | |
| 4,867,031 | A | 9/1989 | Fender | |
| 4,939,971 | A * | 7/1990 | Satoh | 84/313 |
| 5,088,374 | A * | 2/1992 | Saijo | 84/313 |
| 5,109,745 | A * | 5/1992 | Tomita | 84/313 |
| 5,173,565 | A | 12/1992 | Gunn | |
| 5,305,675 | A | 4/1994 | Lasner | |
| 5,481,955 | A * | 1/1996 | Goto | 84/313 |
| 5,542,330 | A | 8/1996 | Borisoff | |
| 5,750,910 | A | 5/1998 | LoJacono | |
| 5,808,216 | A * | 9/1998 | Fisher, IV | 84/313 |

(Continued)

OTHER PUBLICATIONS

Warmoth Nuts, www.warmoth.com/guitar/necks/necks.cfg?fuseaction=stringnut, Nut of same material as the frets, viewed Jul. 30, 2007.

(Continued)

*Primary Examiner*—Jeffrey Donels
*Assistant Examiner*—Robert W Horn
(74) *Attorney, Agent, or Firm*—Harness, Dickey & Pierce, PLC

(57) ABSTRACT

A guitar bridge includes bridge plate having a slot-shaped aperture formed therein. A saddle holder attached to an upper surface of said bridge plate supports a post-shaped saddle. A sustain block having a bore formed therethrough is joined to said bridge plate in a position that aligns the bore with the slot shaped aperture. The guitar bridge is configured to support a guitar string such that a string anchor passes through the bore of the sustain block and rests against the bridge plate without the guitar string contacting any surface of the bridge plate or the saddle holder.

21 Claims, 10 Drawing Sheets

U.S. PATENT DOCUMENTS

| | | | | |
|---|---|---|---|---|
| 5,847,297 | A * | 12/1998 | Fisher, IV | 84/313 |
| 5,939,653 | A * | 8/1999 | Chang | 84/313 |
| 5,952,593 | A | 9/1999 | Wilder | |
| 6,040,510 | A | 3/2000 | Yaun | |
| 6,084,166 | A * | 7/2000 | Lee | 84/313 |
| 6,118,057 | A * | 9/2000 | Chang | 84/298 |
| 6,133,515 | A | 10/2000 | Hoshino | |
| 6,348,646 | B1 | 2/2002 | Parker et al. | |
| 6,465,722 | B2 | 10/2002 | Powers | |
| 6,521,819 | B1 | 2/2003 | Di Iorio | |
| 6,706,957 | B1 | 3/2004 | Merkel | |
| 6,825,406 | B2 * | 11/2004 | Thidell | 84/313 |
| 7,019,202 | B1 | 3/2006 | Hetzel | |
| 7,154,032 | B2 | 12/2006 | Burchfield | |
| 7,297,851 | B2 * | 11/2007 | Caldwell et al. | 84/313 |
| 7,326,839 | B2 | 2/2008 | Kinoshita | |
| 7,339,102 | B2 * | 3/2008 | Folmar et al. | 84/313 |
| 7,488,878 | B2 * | 2/2009 | LaMarra | 84/298 |
| 7,557,282 | B2 * | 7/2009 | Holdway | 84/299 |
| 2002/0088331 | A1 | 7/2002 | Pecanic | |
| 2003/0110920 | A1 * | 6/2003 | Ito et al. | 84/298 |
| 2006/0162528 | A1 | 7/2006 | Kinoshita | |
| 2008/0148919 | A1 * | 6/2008 | LaMarra | 84/307 |

OTHER PUBLICATIONS

Parker Nitefly Mojo, stainless steel saddles, stainless steel frets, viewed Jul. 30, 2007, www.zzounds.com/items-PRKNFO, launched Jul. 9, 2003, www.parkerguitars.com/code/press/pres_display.asp?pressid=25, viewed Jul. 30, 2007.

RMC Pickup Co., Pow'r Bass; Polyphonic Bridge Pickup for Wilkinson-style bridges; May 8, 1999 per Internet Archive Wayback Machine.

RMC Pickup Co., Pow'r Bass 'ST'; Polyphonic Bridge Pickup for Electric Guitar; Aug. 24, 1999 per Internet Archive Wayback Machine.

Fishman Transducers, Inc.—Electric Guitar Pickup and Accessories, Feb. 13, 2004 per Internet Archive Wayback Machine.

Fret Not Guitar Repair; Guitar Saddles, Nov. 14, 2002, per Internet Archive Wayback Machine.

"How to Make Your Electric Guitar Play Great", Erlewine, D.; Library of Congress Control No. 00-136124, ISBN 0-87930-607-7, p. 67, (c) 2001 Backbeat Books, Milwaukee, WI.

* cited by examiner

GUITAR BRIDGE WITH A SUSTAIN BLOCK AND TUNE-O-MATIC SADDLES

CROSS-REFERENCE TO RELATED APPLICATIONS

This application is a continuation-in-part of U.S. patent application Ser. No. 11/333,734 filed on Jan. 16, 2006. The disclosure of the above application is incorporated herein by reference in its entirety for any purpose.

FIELD

This disclosure relates to a guitar bridge, and more particularly to a guitar bridge having a sustain block and post-shaped (e.g., Tune-O-Matic) saddles.

BACKGROUND

A guitar's unique tone and playability is the result of many factors, including the type and configuration of the guitar bridge and saddles. For example, a tremolo bridge with a sustain block has tone and playability (e.g., feel) characteristics preferred by many. Also, a Tune-O-Matic bridge has its own tone and feel. Characteristics of both types of bridges impact the overall tone and playability of the guitar in recognizable ways.

A tremolo bridge typically includes a bridge plate, a sustain block, springs, and a tremolo bar. One end of the bridge plate is beveled to allow the bridge plate to pivot or rock. Bridge mounting screws attach the beveled end of the bridge plate to the front of the guitar body via bridge mounting holes on the beveled end. The bridge mounting screws are configured such that a smooth shank portion of the screw is exposed above the guitar body and below the screw head. When the bridge plate pivots, the bridge mounting holes slide on the smooth shank portions of the bridge mounting screws.

The tremolo bar is received through an aperture in the bridge plate by a sustain block that is attached to the bridge plate and positioned in a cavity within the guitar body. The bridge plate is asymmetrically designed, with a greater portion of the bridge plate on the side of the tremolo bar to allow for the aperture through which the tremolo attaches to the sustain block.

Guitar strings on a guitar with a tremolo bridge are installed through the sustain block and bridge plate. The guitar strings are fed through string saddles attached to the guitar bridge. Traditionally, the strings are fed through grooves or channels in the string saddles. At the other end of the guitar, the guitar strings are fed through a nut and string trees and attached to tuning keys on the head stock. The portion of the guitar string between the string saddles and the nut vibrates when plucked or strummed producing the guitar's sound. When the guitar player frets a note, the vibrating portion of the string between the fret and the string saddle produces the sound. The material and shape of the string saddles, nut, and frets each affect the tone of the guitar in recognizable ways.

Springs attached to the sustain block impart a biasing force on the sustain block, and bridge plate, returning the bridge plate to a flat position relative to the guitar body when the tremolo bar is not being operated. When the tremolo bar is operated, the sustain block and bridge plate pivot and the pitch of the note being played is lowered. The tremolo bar may be operated by successive pushing and releasing to achieve a vibrato effect.

While the sustain block and springs are integral to the operation of the tremolo bar, each contributes in a recognizable way to the overall tone of the guitar even when the tremolo bar is not operated. For example, the sustain block increases the resonance of a note being played, while the springs increase the reverberation of the note. Thus, the tone enhancing effects of the sustain block and tension springs are desirable characteristics of the tremolo bridge aside from the tremolo bar functionality.

Yet, many players who appreciate the characteristics and advantages of a tremolo bridge also enjoy the tonal characteristics provided by a Tune-O-Matic style bridge. The Tune-O-Matic style bridge has notched posts for saddles and the strings are generally anchored by passage to a stop bar tailpiece or string through of the guitar body. The stop bar tail piece is preferred by many for tone because the strings terminate at the ball ends of the string without contacting other materials. In either case, this passage has a more gentle angle than is exhibited with a tremolo bridge, which pulls the strings down at a sharper angle across an edge of the bridge.

What is needed is a bridge that combines characteristics and advantages of a tremolo bridge with those of a Tune-O-Matic bridge. The guitar bridge disclosed herein fulfills this need.

SUMMARY

A guitar bridge includes bridge plate having a slot-shaped aperture formed therein. A saddle holder attached to an upper surface of said bridge plate supports a post-shaped saddle. A sustain block having a bore formed therethrough is joined to said bridge plate in a position that aligns the bore with the slot shaped aperture. The guitar bridge is configured to support a guitar string such that a string anchor passes through the bore of the sustain block and rests against the bridge plate without the guitar string contacting any surface of the bridge plate or the saddle holder.

Further areas of applicability of the disclosed guitar bridge will become apparent from the detailed description provided hereinafter. It should be understood that the detailed description and specific examples, while indicating the preferred embodiment of the novel guitar bridge, are intended for purposes of illustration only and are not intended to limit the scope of the disclosure.

BRIEF DESCRIPTION OF THE DRAWINGS

The present teachings will become more fully understood from the detailed description and the accompanying drawings, wherein:

FIG. 11, including

DETAILED DESCRIPTION

The following description is merely exemplary in nature and is in no way intended to limit the disclosed guitar bridge, its application, or uses.

Referring to FIGS. 1-6 a guitar bridge 10 is shown. The guitar bridge 10 includes a bridge plate 12, and a sustain block 14.

Figure 2:
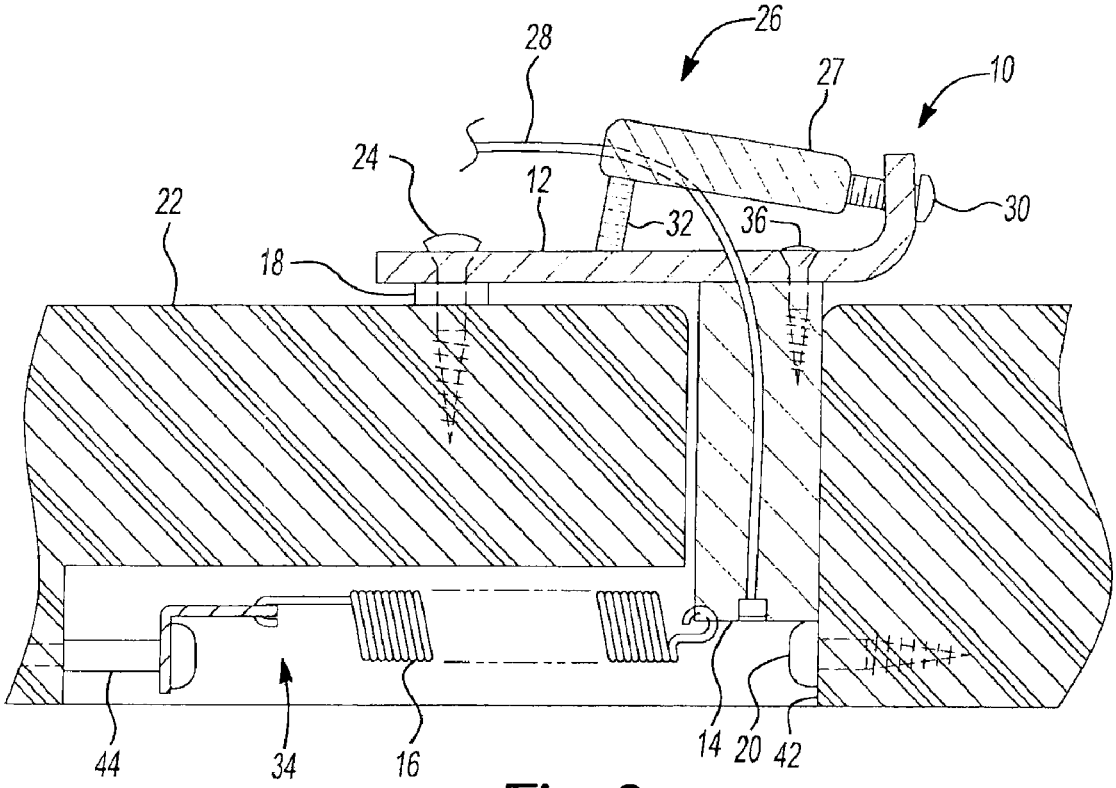
FIG. 2 is a cross-sectional view of a guitar bridge, with springs, positioned offset from a guitar body.
Figure 3:
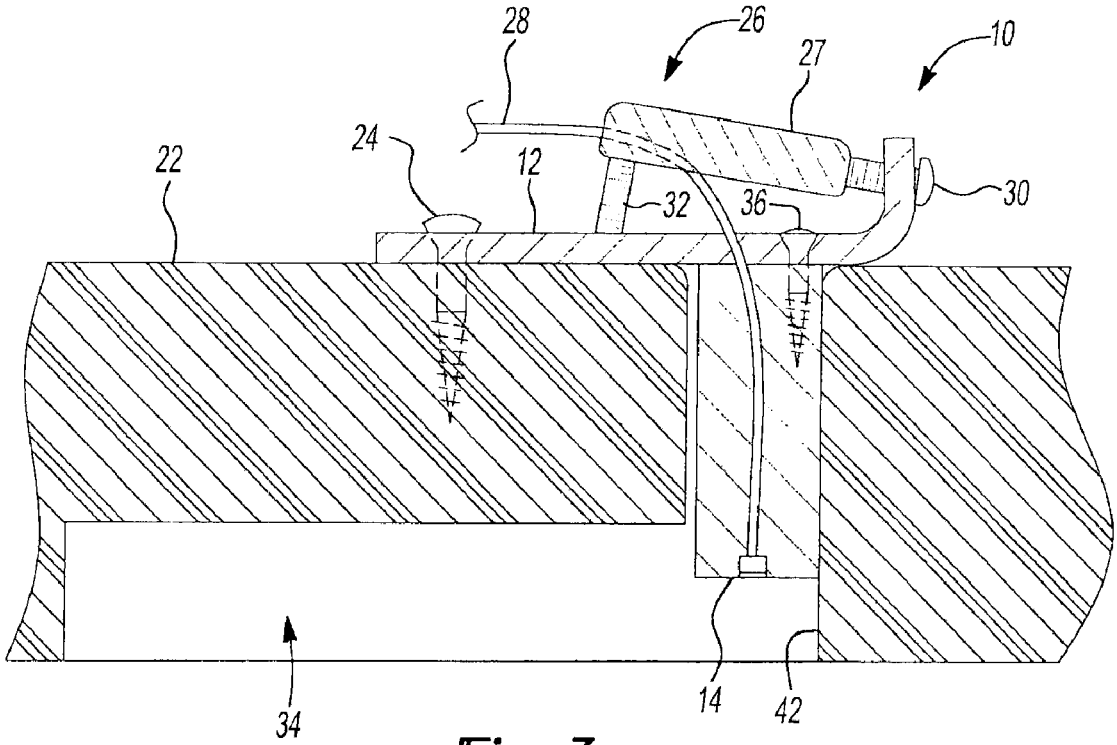
FIG. 3 is a cross-sectional view of a guitar bridge, without springs, positioned flush against a guitar body.

Referring now to FIGS. 2 and 3, the bridge plate 12 is attached to the front of a guitar body 22 with at least one plate-to-body mounting screw 24. Two plate-to-body mounting screws 24 may secure the bridge plate 12 to the front of the guitar body 22. Additional plate-to-body mounting screws 24 may be used. For example, four plate-to-body mounting screws 24 may be used with one plate-to-body mounting screw at each corner of the bridge plate 12. The position of the bridge plate 12 is fixed relative to the guitar body 22. At least one string saddle 26 with a saddle body 27 is positioned on the bridge plate 12, and includes a slot or channel for receiving a guitar string 28. The string saddle 26 is attached to the bridge plate 12 with a string saddle mounting screw 30. The angle of the string saddle 26 relative to the bridge plate 12 is adjusted via string saddle adjusting screws 32. In a six string guitar embodiment, such as a Stratocaster style guitar, six string saddles 26 are positioned on the bridge plate 12. It is understood that any suitable string saddle 26 may be installed on the bridge plate 12.

A sustain block 14 is positioned beneath the bridge plate 12 within a cavity 34 of the guitar body 22. The sustain block 14 is attached to the bridge plate 12 via at least one plate-to-block mounting screw 36 such that the top of the sustain block 14 is flush against the underside of the bridge plate 12. In this way, a stable coupling exists between the bridge plate 12 and sustain block 14. Three plate-to-block mounting screws 36 may be used to secure the bridge plate 12 to the sustain block 14. Guitar strings 28 are installed through string apertures in the sustain block 14 and the bridge plate 12. The guitar strings 28 are received by the string saddles 26. The ends of the guitar strings 28 are terminated with a string terminator, such as a ball, a bullet, a ring, or other suitable means for terminating the guitar string such that it may be pulled taut against the sustain block 14. The string apertures include a recessed portion to allow the string terminator to be positioned within the sustain block 14 such that no portion of the terminator extends beyond the end of the sustain block 14. In an alternate embodiment, the string apertures may not include the recessed portion.

In this way, a bridge plate 12 is stably attached to the guitar body 22 in a fixed position. The bridge plate 12 is configured with a sustain block 14 that is stably attached to the bridge plate 12. The bridge 10 provides the tuning stability typically associated with a fixed-tail bridge as well as the tone enhancing characteristics typically associated with a sustain block 14 of a tremolo bridge. Because a tremolo bar is not included, the bridge plate 12 may be symmetrically designed. Further, the sustain block 14 need not be "blocked" in order to prevent pivoting of the sustain block 14.

Figure 1:
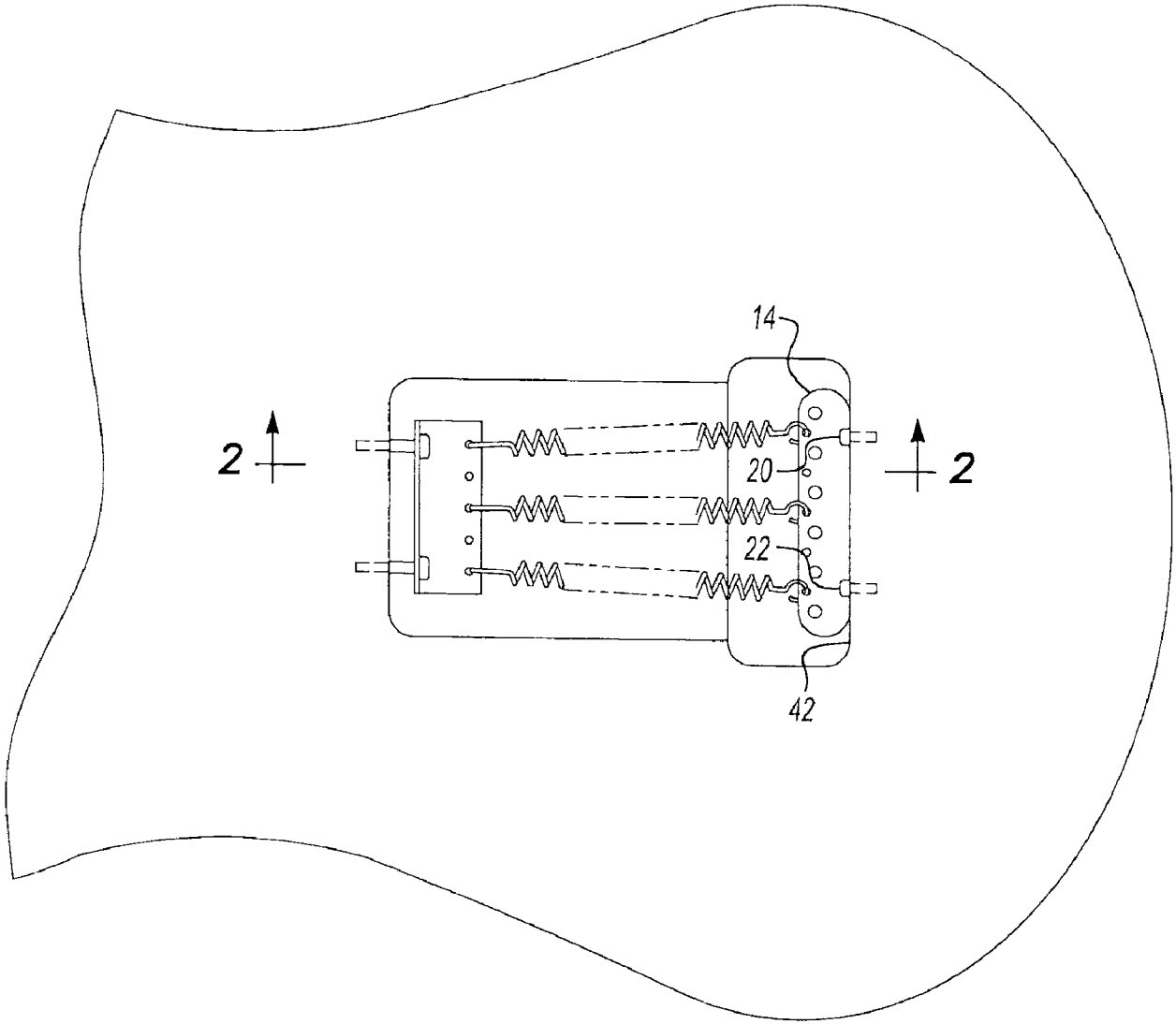
FIG. 1 is a perspective view of a sustain block and tremolo springs.

Because the bridge plate 12 does not pivot, springs 16 are not required for the bridge 10 to function. However, at least one spring 16 may be installed nonetheless to increase the reverberation. For example, three springs 16 may be installed. Springs 16 are attached to the sustain block 14 and to a spring mounting bracket 44 within the cavity 34. In FIGS. 1 and 2, the guitar bridge 10 is illustrated with springs 16 installed. In FIG. 3, the guitar bridge 10 is illustrated without springs 16 installed. The springs 16 are removable and may be easily reinstalled to suit changing tone preferences. Additionally, the number and size of the springs 16 may be varied to suit changing tone preferences as well.

The sustain block 14 is wide enough to receive all of the strings 28 of the guitar. A traditional Stratocaster style guitar utilizes six strings 28. However, guitars with more or with less strings 28 are not uncommon. In addition, a traditional bass guitar utilizes four strings 28. In an alternate embodiment, the guitar bridge 10 may be adapted to accommodate guitars, or bass guitars, with any number of strings 28.

Because the sustain block 14 does not receive a tremolo bar, the sustain block 14 need not be as wide as the sustain block 14 utilized by a tremolo bridge. However, the size, including the height, width, and thickness, of the sustain block 14 may vary the tone of the guitar. Resonance increases as the mass of the sustain block 14 increases. Sustain blocks 14 of varying size and mass could be alternately installed on a guitar to suit changing tone preferences.

In FIG. 1, the sustain block 14 is positioned within the cavity such that the sustain block 14 is flush against a sidewall 42 of the cavity 34. The sustain block 14, however, need not be flush against the sidewall 42 of the cavity 34 to function properly. Thus, the guitar bridge 10 is compatible with any suitable guitar body cavity 34 large enough to receive the sustain block 14.

The position of the bridge plate 12 relative to the guitar body 22 affects the overall guitar tone. The bridge plate 12 may be offset from the guitar body 22 or flush against the guitar body 22. In FIG. 2, the bridge plate 12 is offset from the guitar body 22. Offset washers 18 are installed between the bridge plate 12 and the guitar body 22 such that the plate-to-body mounting screws 24 are received by the offset washers 18. The amount of bridge position offset may be adjusted by varying the thickness of the offset washers 18. A guitar with a bridge 10 that is offset relative to the guitar body 22 will have a unique tone that may be preferable to other guitars with other bridge configurations. A bridge plate 12 that is offset from the guitar body 22 may produce a tone similar to that produced by a tremolo bridge with a pivoting beveled end bridge plate than a bridge plate attached flush with the guitar body. In addition, the offset position of the bridge plate 12 may be preferable to those who desire to distinguish the tone of their Stratocaster style guitar from the tone of a Telecaster style guitar. Telecaster style guitars are traditionally equipped with a fixed bridge plate 12 that is attached flush against the guitar body 22.

In FIG. 3, the bridge plate 12 is attached flush against the guitar body 22 without an offset. A guitar with a bridge 10 that is flush against the guitar body 22 will also have a unique tone that may be preferable to other guitars with other bridge configurations. For example, some may desire to make the tone of their Stratocaster style guitar sound more like a traditional Telecaster style guitar by attaching the bridge plate 12 flush against the guitar body 22.

Referring now to FIGS. 1 and 2, securing screws 20 are attached to the sidewall 42 of the cavity 34, further securing the position of the sustain block 14 within the cavity 34. Because the sustain block 14 is attached flush against the bridge plate 12, securing screws 20 are not essential for the bridge 10 to function. However, the securing screws 20 provide additional position stability for the sustain block 14, and also provide a coupling between the sustain block 14 and the guitar body 22 which affects the overall guitar tone in a unique way. The securing screws 20 may not be included. In FIG. 3, the guitar bridge 10 is illustrated without securing screws 20.

In FIG. 2, in an embodiment with a bridge plate 12 that is offset from the guitar body 22, and that utilizes springs 16, the securing screws 20 may secure the sustain block 14 in the desired position. As described above, the bridge 10 may be configured with a number of springs 16, of varying size. The tension of the springs 16 may pull on the sustain block 14 and bridge plate 12, pulling the bridge plate 12 towards the guitar body 22. In such a configuration, securing screws 20 may be used to stabilize the position of the sustain block 14. In this way, additional springs 16 may be added without affecting the position of the sustain block 14 and bridge plate 12.

Figure 5:
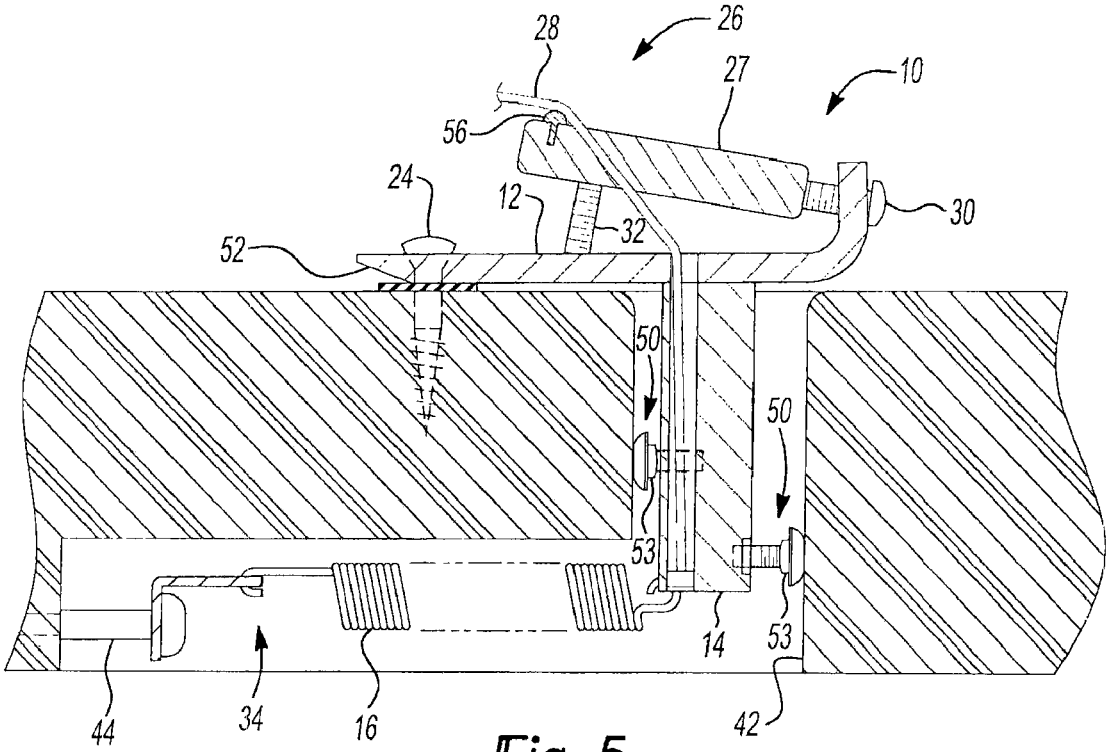
FIG. 5 is a cross-sectional view of a guitar bridge with positioning screws and with springs.
Figure 6:
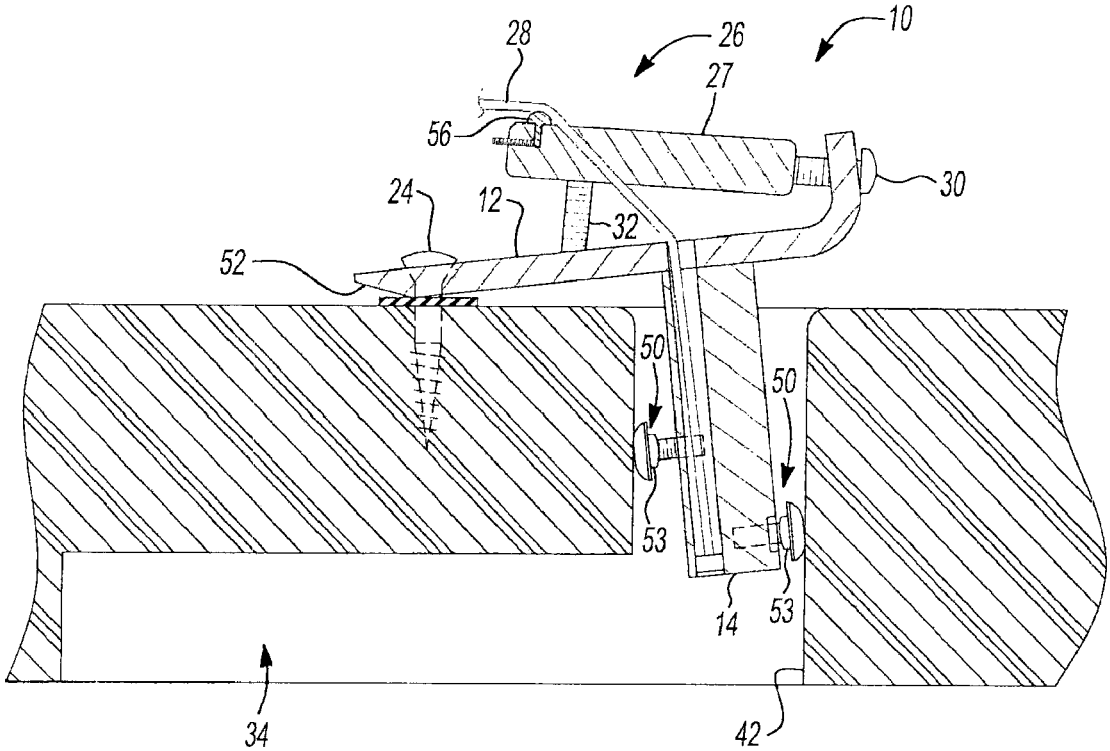
FIG. 6 is a cross-sectional view of a guitar bridge with positioning screws and without springs.

Referring now to FIGS. 5 and 6, a guitar bridge 10 is shown with positioning screws 50 attached to the sustain block 14. The positioning screws 50 are attached to opposite sides of the sustain block 14. The heads of the positioning screws 50 contact the sidewalls 42 of the cavity 34. The bridge plate 12 includes a beveled edge 52. The position of the sustain block 14 within the cavity and the angle of the bridge plate 12 with the guitar body is fixed by the positioning screws 50. For example, in FIG. 5, the positioning screws are adjusted such that the bridge plate 12 is parallel with the guitar body 22 and the sustain block 14 is parallel with the sidewalls 42 of the cavity 34. In FIG. 6, the positioning screws 50 are adjusted such that the bridge plate 12 is angled away from the guitar body 22. By adjusting the positioning screws 50, both the position of the sustain block 14 within the cavity 34 and the angle of the bridge plate 12 with the guitar body 22 are controlled. The position of the sustain block 14 within the cavity 34 and the angle of the bridge plate 12 with the guitar body may be adjusted to suit the preferences of the guitar player. The sustain block 14 may be configured with springs, as shown in FIG. 5, or without springs, as shown in FIG. 6.

Two positioning screws 50, one on each side of the sustain block, are shown in FIGS. 5 and 6. However, one positioning screw 50 may be used. For example, to position the bridge plate 12 flat against the guitar body 22, one positioning screw 50 on the side of the sustain block 14 opposite the beveled endedge 52 of the bridge plate 12 may be used. Further, more than two positioning screws 50 may be used for additional coupling between the sustain block 14 and the guitar body 22.

The sustain block 14 includes bores for receiving the positioning screws 50. The head of the positioning screws 50 may include an adjustment portion 53, such as a hex nut portion, beneath the screw head to allow for wrench adjustments of the positioning screws 50. The bores may include counter-sinks for receiving the adjustment portion 53 of the positioning screw 50. In this way, the head of the positioning screw 50 may be flush against the sustain block 14 when the positioning screw 50 is screwed all the way in to the sustain block 14.

Figure 7A:
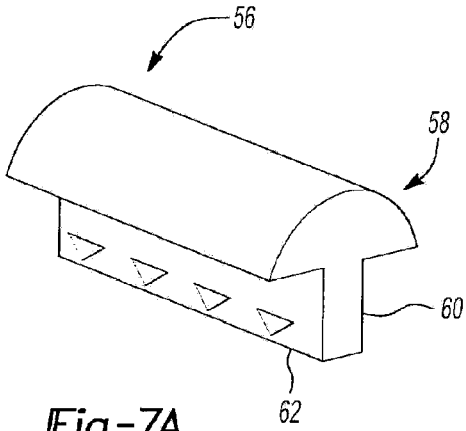
FIG. 7A is a fret wire.
Figure 7B:
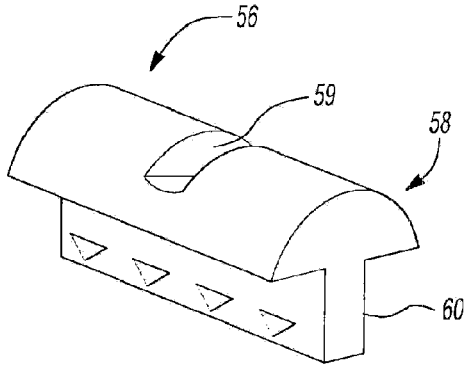
FIG. 7B is a fret wire with a groove for receiving a guitar string.

In FIGS. 5 and 6 the string saddles 26 are configured with fret wire 56. As shown in FIGS. 7A and 7B, the fret wire 56 includes a crown 58 and a tang 60. The sidewalls of the tang include barbs 62. The crown 58 may include a groove 59 for receiving a guitar string 28, as shown in FIG. 7B. The crown 58 may not include a groove, as shown in FIG. 7A.

Referring again to FIGS. 5 and 6, the fret wire 56 is positioned within a fret wire receiving channel in the saddle body 27. The barbs 62 engage the sidewalls of the fret wire receiving channel to secure the tang 60, and consequently the fret wire 56. Additionally, a set screw 64 may be used to further secure the fret wire 56. The set screw 64 is received by a bore in the end of the saddle body 27 opposite the string saddle mounting screw 30. The set screw 64 engages the tang to secure the fret wire 56 in the fret wire receiving channel in the saddle body 27.

The guitar string 28 is strung through the sustain block 14, through the bridge plate 12, through the string saddle 26, and over the fret wire 56. In this way the guitar string 28 leaves the string saddle 26 over the fret wire 56 which provides a pronounced terminating point for the vibrating section of the guitar string 28. In the traditional string saddle 26 the guitar string 28 leaves the string saddle 26 through a channel in the string saddle 26. The channel however does not provide a pronounced terminating point for the vibrating section of the guitar string 28. In FIGS. 5 and 6, the fret wire 56 in the string saddle 26 bends the guitar string 28 as it exits the string saddle 26 at a definite angle. In the traditional string saddle 26, the guitar string 28 is not bent at a definite angle as it exits the string saddle 26.

Figure 4:
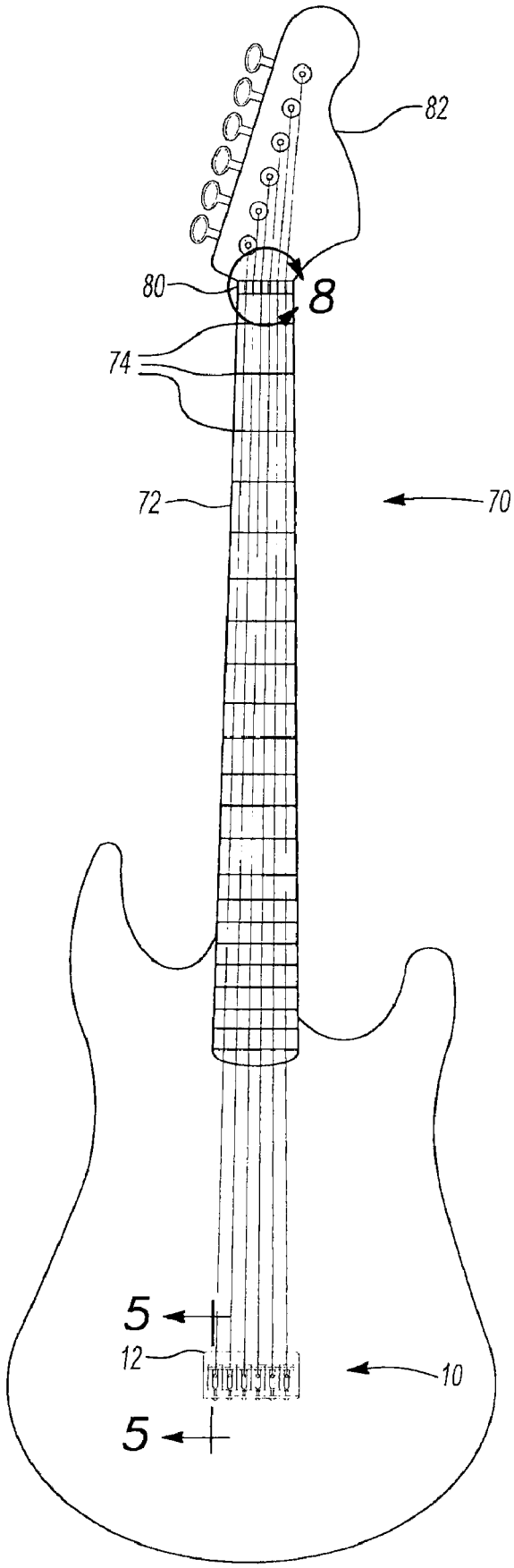
FIG. 4 is a view of a guitar with a guitar bridge, a fret board, and a nut.

With additional reference to FIG. 4, the neck 70 of the guitar includes a fret board 72. The frets 74 on the fret board 72 are constructed by placing fret wire 56 in fret wire receiving channels on the fret board 72 that are perpendicular to the guitar strings 28. The fret wire 56 is placed in the fret wire receiving channel such that the underside of the crown 58 is flush with the fret board 72. The barbs 62 of the fret wire 56 engage the sidewalls of the fret wire receiving channels in the fret board 72.

The fret wire 56 in the string saddles 26 may be the same material as the fret wire 56 in the fret board 70 of the guitar. In constructing a guitar, stock fret wire 56 is cut to the desired lengths and installed on the fret board 72. The same stock fret wire 56 used in the fret board 72 can also be cut to match the width of the saddle body 27 and installed on each string saddle 26.

Figure 8:
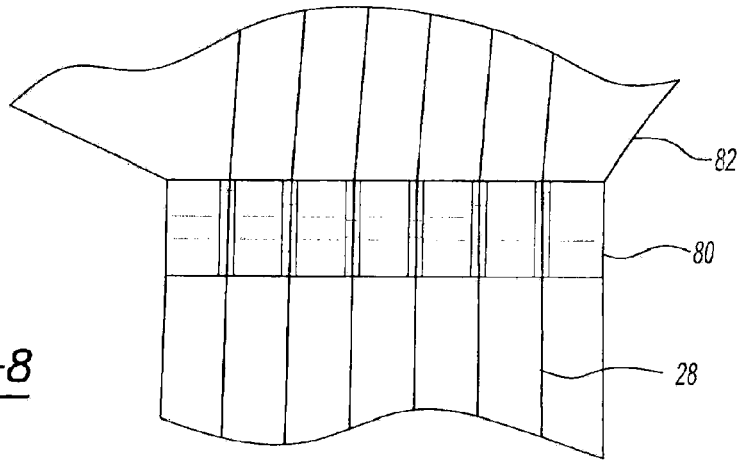
FIG. 8 is a nut and headstock.
Figure 9:
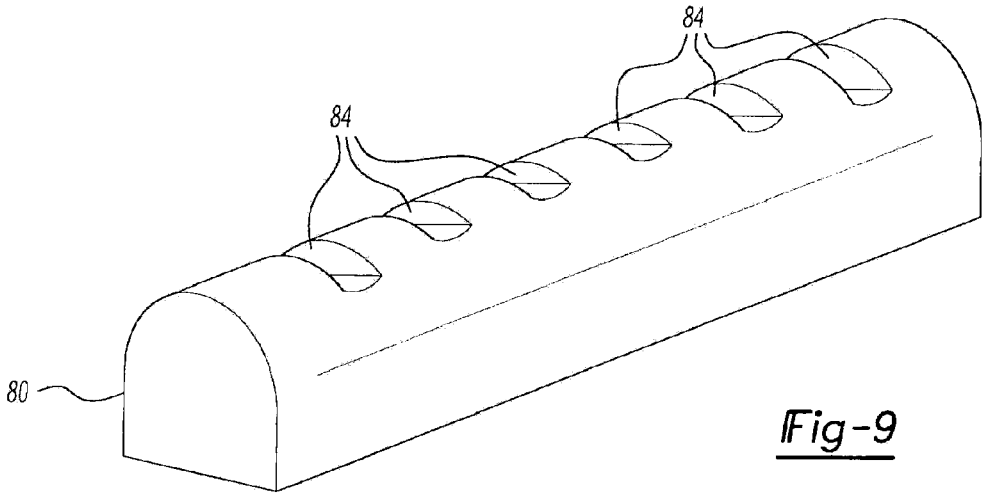
FIG. 9 is a nut.

Referring now to FIGS. 4, 8, and 9, a nut 80 is installed on the headstock 82 of the guitar. The guitar strings 28 are received by channels 84 in the nut. The nut 80 terminates the vibrating portion of the guitar string 28. Thus, while the ends of the guitar string 28 are located at the sustain block 14 and the tuning keys 86, the vibrating portion of the guitar string 28 is located between the nut 80 and the string saddle 26. The guitar player may press the guitar string 28 behind one of the frets 74 in the fret board 72 to play a desired note. In such case, the vibrating portion of the guitar string 28 is between the string saddle 26 and the chosen fret 74 in the fret board 72.

The material of the nut may be chosen to match the material of the fret wire 56 used in both the fret board 72 and the string saddles 26. In this way, the vibrating portion of the guitar string will contact the same type of material at the nut, at the frets 74 in the fret board 72 and at the fret wire 56 in the string saddles 26. This uniformity of material produces a distinct and desirable tone. The guitar produces crisp and sharp notes regardless of whether the guitar strings are fretted or played open.

Because tone preference is a subjective matter, certain configurations of the guitar bridge may be preferable depending on the musical setting and desired target tone.

Figure 10:
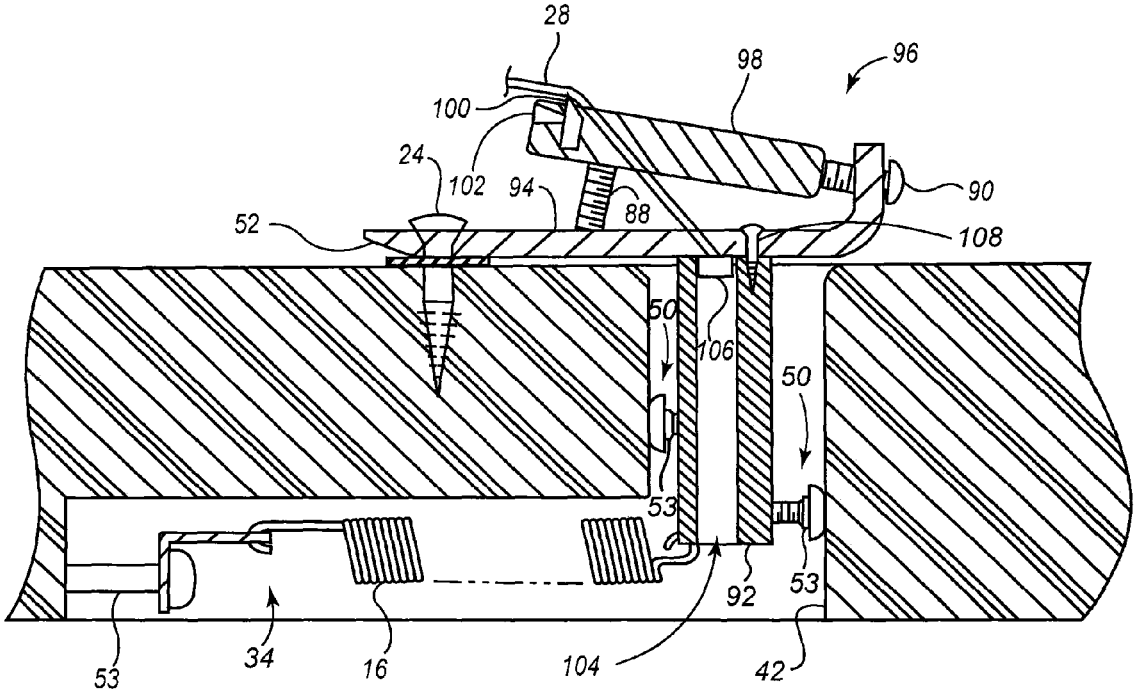
FIG. 10 is a cross-sectional diagram illustrating an embodiment of a guitar bridge having a sustain block and a post-shaped saddle, such as a Tune-O-Matic style saddle.

Turning now to FIG. 10, another embodiment of a guitar bridge 96 has components present in other embodiments described above. Such components include springs 16, plate to body mounting screws 24, guitar string 28, cavity 34, sidewall 42, spring mounting bracket 44, positioning screws 50, beveled edge 52, and adjustment portion 53. In addition to these components, guitar bridge 96 has additional or alternative components.

Additional or alternative components of guitar bridge 96 are selected and positioned to obtain a tone characteristic of a Tune-O-Matic style bridge while retaining functional characteristics of a tremolo style bridge, such as a fixed or floating tremolo style bridge. For example, guitar bridge 96 has a saddle holder 98 that has a saddle holding slot sized and shaped to hold a post-shaped saddle 100, such as a Tune-O-Matic style saddle. The saddle 100 is preferable composed of brass or nickel and has a notch by which guitar string 28 is held in position when disposed to cross the saddle 100 while under tension. Guitar string 28 under tension presses the saddle 100 against a bottom wall of the saddle holding slot while in place, and thus holds the saddle 100 in the saddle holding slot. The saddle holder 98 also has a threaded aperture formed through a wall of the saddle holding slot. A set screw 102 is threaded through the threaded aperture and positioned to press against the saddle 100. The set screw 102 applies pressure to the saddle 100 and presses the saddle 100 against an opposite wall of the saddle holding slot. Accordingly, friction holds the saddle 100 in place within the saddle holding slot even when string 28 is removed.

Saddle holder 98 is attached to a bridge plate 94 by saddle holder mounting screw 90. Saddle holder adjusting screw 88 directly contacts the bridge plate 94 and is threaded through the saddle holder 98. Adjusting screw 88 is adjustable to control a distance of the saddle holder 98 from the bridge plate 94 when the string 28 is disposed across the saddle 100 while under tension.

Bridge plate 94 is attached to a sustain block 92 by joining member 108. Each of bridge plate 94 and sustain block 92 have joining member apertures through which the joining member 108 is threaded and holds the sustain block in direct contact with the bridge plate 94. Sustain block 92 has a chamber formed completely through from an end of the sustain block 92 that is directly in contact with the bridge plate 94 to another end of the sustain block that faces away from the bridge plate 94. This chamber is sized to allow passage therethrough of string 28 and string anchor 106. In other words, string anchor 106, such as a conventional ball end, is held directly in contact with the bridge plate 94 when string 28 is under tension.

Figure 11A:
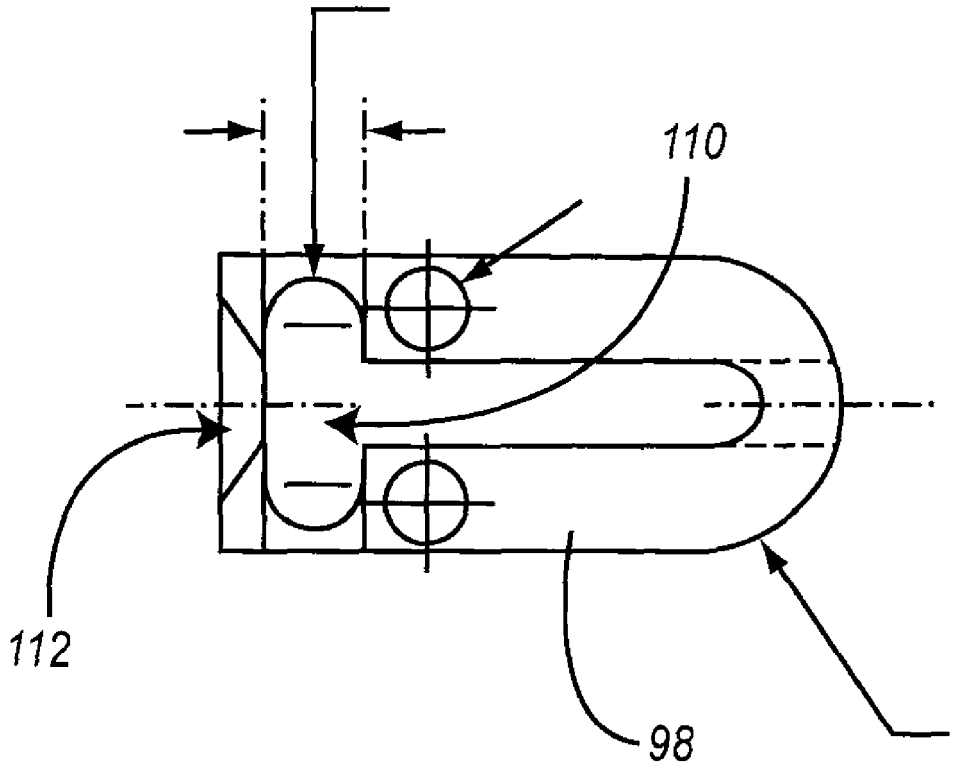
FIGS. 11A-11C, are scale diagrammatic views illustrating components of the guitar bridge of FIG. 10, including a string saddle holder (FIG. 11A), a sustain block (FIG. 11B), and a bridge plate (FIG. 11C)
Figure 11A:
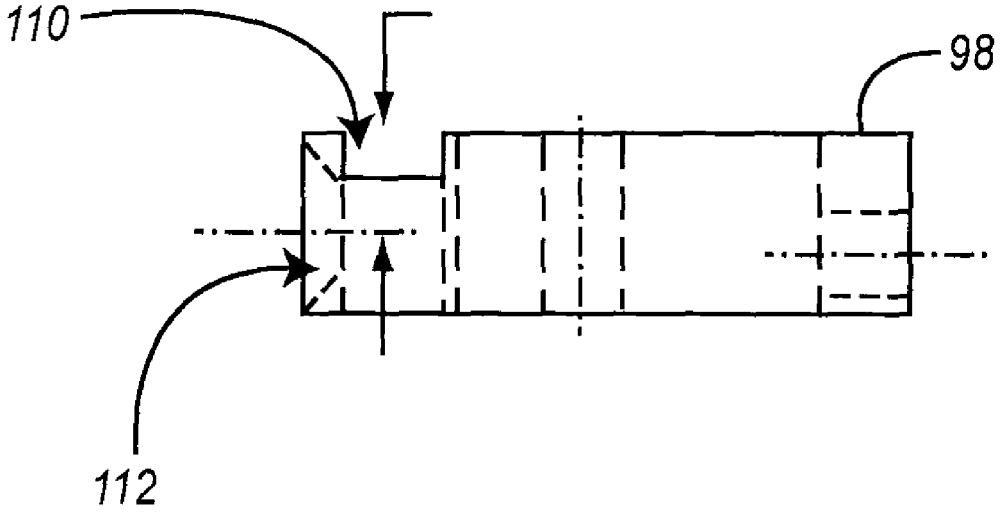

Turning now to FIG. 11A, saddle holder 98 is generally shaped like a saddle of tremolo style bridge. However, saddle holder 98 has a saddle holding slot 110 having a size and shape predetermined to hold a post-shaped saddle. Preferably, saddle holding slot 110 is sized and shaped to hold a Tune-O-Matic style bridge saddle. Saddle holder 98 also has a set screw aperture 112 formed in a side wall of the saddle holding slot 110. The set screw aperture is sized and positioned to hold a threaded set screw against a base of the post shaped saddle.

Figure 11B:
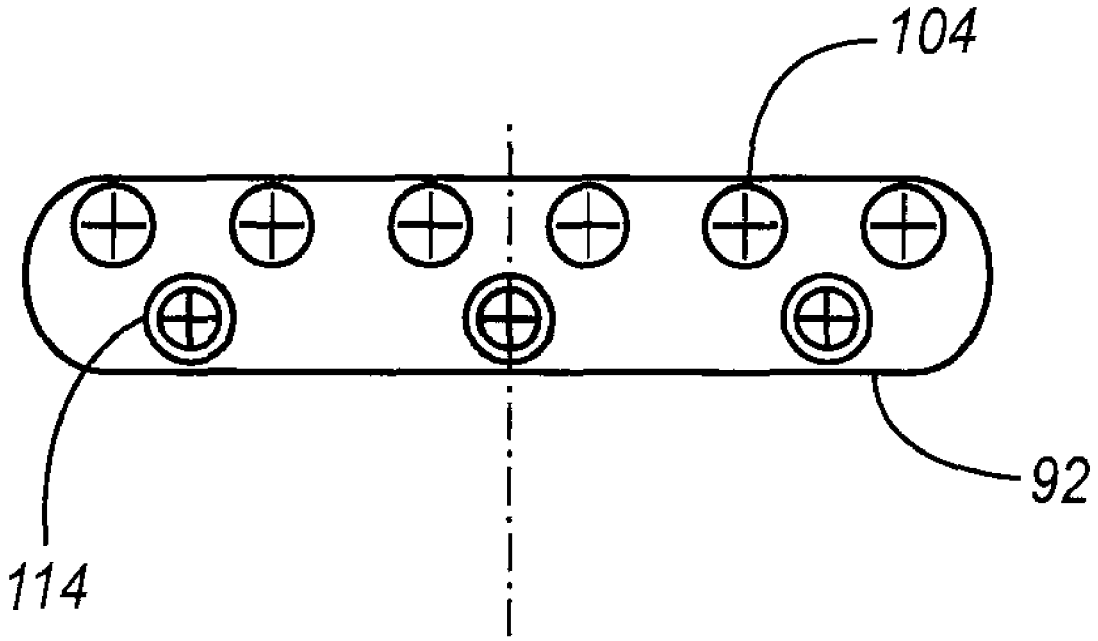

Turning now to FIG. 11B, a sustain block 92 has at least one chamber 94 formed completely through the sustain block 92. This chamber 94 preferably has a diameter greater than or equal to 0.156 inches to allow passage of a typical string anchor, such as a conventional ball end, so that the string anchor directly contacts the bridge plate. At least one joining member aperture 114 in the sustain block attaches the sustain block 92 to a bridge plate.

Figure 11C:
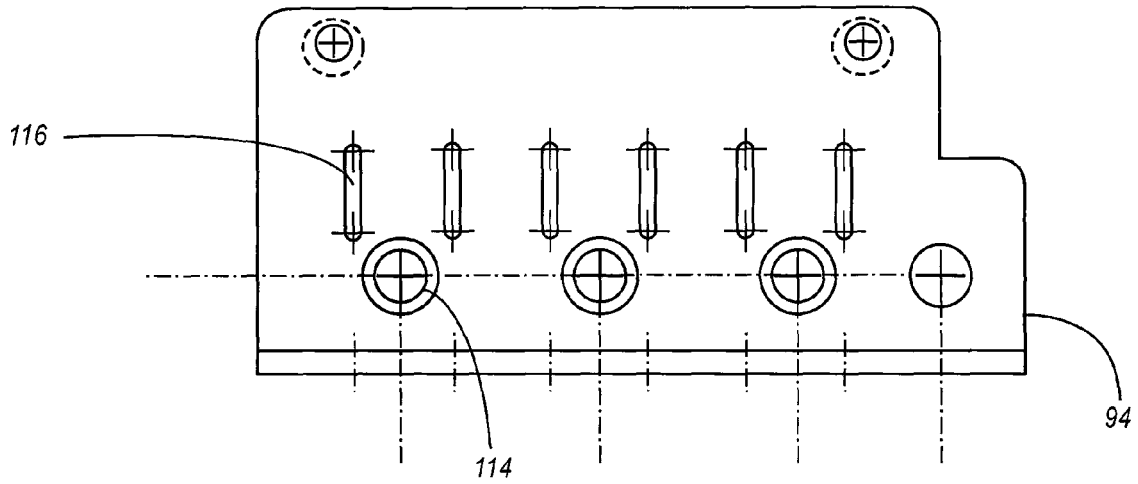

Turning now to FIG. 11C, a bridge plate 94 has at least one joining member aperture 114 positioned to hold the sustain block in contact with the bridge plate. The bridge plate 94 has at least one slot-shaped aperture 116 that allows passage of a string through the bridge plate 94 to a saddle. Unlike holes in conventional bridge plates, aperture 116 has a position and length predetermined to pass a guitar string from a string anchor in contact with the bridge plate directly to a saddle. The string is passed though the bridge plate 94 and the saddle holder to the saddle. The string is suspended under tension between the string anchor and the saddle without the string contacting the bridge plate 94 or the saddle holder. Predetermined sizes, shapes, and positions of joining member aperture 114, aperture 116, and the sustain block chamber are predetermined to ensure that the string anchor is aligned with the aperture 116. For example, a length of the aperture 116 that is greater than its width is sufficient to permit passage of the string from the string anchor to the saddle without the string being pulled down to the string anchor against an edge of the aperture 116. In order to accommodate numerous saddle heights, a length of the aperture 116 is at least is at least 0.33 inches. More preferably, the length is 0.354 inches ±0.0052 inches. The aperture 116 is oriented in a lengthwise direction matching a direction of passage of the guitar string from the string anchor to the saddle.

To ensure that the string anchor, such as a conventional ball end, does not pass through the aperture 116, the aperture 116 has a width less than 0.156 inches, which is a diameter of a standard string ball end at its widest point. The standard ball end that contacts the bridge plate also has another width in another direction that is smaller than the width of the ball end at its widest point. When the ball end is rotated in the slot, it can obtain a position that allows it to slip through the slotted aperture. Therefore, the slotted aperture is preferably narrower in width than the narrowest width of the string anchor. Also, to ensure that the string can pass though the aperture 116, the aperture 116 has a width greater than 0.008 inch, which is a width of a thinnest conventional electric guitar string. More preferably, the aperture 116 has a width of 0.0625 inches ±0.0052 inches in order to permit passage of strings having widths up to 0.060 inches, while successfully preventing passage of a vast majority of string anchors. In contrast, previous bridge plates have had holes for string passage that are 0.125 inches in diameter, and have relied on the sustain block without a through hole passage to prevent passage of the string anchor.

Figure 12:
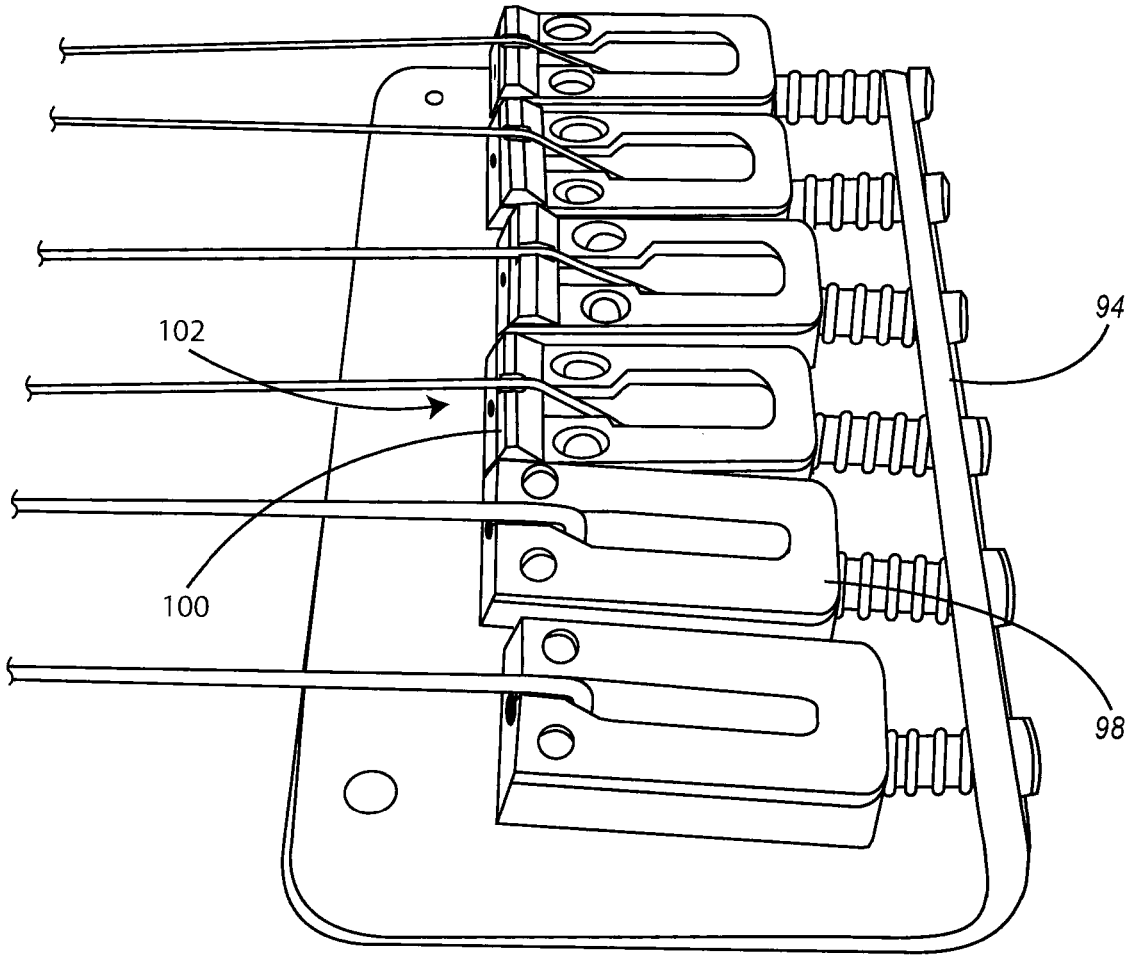
FIG. 12 is a perspective view of the guitar bridge of FIG. 10.

Turning finally to FIG. 12 and referring generally thereto, a guitar having the bridge described above exhibits a post-shaped saddle 100, such as a Tune-O-Matic saddle. The saddle 100 is positioned in a saddle holding slot of a saddle holder 98. The saddle is held in the saddle holding slot in part by a set screw 102.

The saddle 100 has a height and the saddle holding slot has a depth that are predetermined to ensure that a guitar string passing over the saddle 100 is held at one or more predetermined angles by which the string extends from the saddle to a position of a string anchor. The string anchor is directly in contact with the bridge plate and aligned with slot-shaped apertures formed in the saddle holder 98 and bridge plate 94. The predetermined angle passes the guitar string though the slot-shaped apertures to the string anchor without contacting the saddle holder 98 or the bridge plate 94. In other words, the string extends directly from the string anchor to the saddle 100 without contacting any other surface. This objective is obtained by coordinated formation and placement of various bridge components.

The objective of passing the string from the saddle 100 to the string anchor without contacting any surface of the saddle holder or bridge plate is accomplished by: (a) forming a passage through a sustain block that allows passage of a string anchor through the passage to a surface of a bridge plate; (b) forming a slot-shaped aperture in the bridge plate; and (c) align the string anchor with the slot shaped aperture by joining of the sustain block to the bridge plate. For example, the objective is obtained in part by forming the slot-shaped aperture to prevent passage of the string anchor through the slot-shaped aperture. Also, the objective is in part obtained by positioning the sustain block passage so that the string anchor is aligned toward an end of the slot-shaped aperture that is formed in the bridge plate and furthest away from the saddle. The objective is further obtained in part by forming the slot-shaped aperture to have a length predetermined to allow the string to extend in a lengthwise direction towards the saddle and upwards at the predetermined angle to the saddle without contacting any surface of the bridge plate 94.

The bridge described above can vary in some aspects. For example, it should be readily understood that the bridge can be a fixed bridge or a floating bridge. It should also be readily understood that the post-shaped saddles can be of varying shapes and sizes, and made of various materials. Additionally, it should be readily understood that saddles simultaneously mounted in the bridge can be of different materials. It should further be readily understood that each saddle can have its own saddle holder, or that some saddle holders can hold more than one saddle. Yet further, it should be readily understood that the bridge can simultaneously have some saddles as described above and other styles of saddles.

Further, the description of the guitar bridge is merely exemplary in nature and, thus, variations that do not depart from the gist of the disclosure are intended to be within the scope of its teachings. Such variations are not to be regarded as a departure from the spirit and scope of the disclosure.

What is claimed is:

1. A guitar bridge, comprising:

a bridge plate having a slot-shaped aperture formed therein;

a saddle holder attached to an upper surface of said bridge plate;

a post-shaped saddle support by said saddle holder;

a sustain block having a bore formed therethrough, said sustain block is joined to said bridge plate in a position that aligns said bore with said slot shaped aperture; and wherein said guitar bridge is configured to support a guitar string such that a string anchor passes through said bore of said sustain block and rests against said bridge plate without the guitar string contacting any surface of said bridge plate or said saddle holder.

2. The guitar bridge of claim 1, wherein said slotted aperture has a width sized to prevent passage of the string anchor therethrough.

3. The guitar bridge of claim 2, wherein said width is in a range from 0.156 inches to 0.008 inches.

4. The guitar bridge of claim 2, wherein said width is 0.0625 inches or less.

5. The guitar bridge of claim 2, wherein said width is 0.0625 inches ±0.0052 inches.

6. The guitar bridge of claim 1, wherein the slotted aperture has a length sized to prevent passage contact with the string.

7. The guitar bridge of claim 1, wherein said length of said slotted aperture is at least 0.33 inches.

8. The guitar bridge of claim 1, wherein said length of said slotted aperture is at 0.354 inches ±0.0052 inches.

9. The guitar bridge of claim 1, wherein said sustain block bore is positioned near an end of the slotted aperture that is oriented away from the saddle.

10. The guitar bridge of claim 1, wherein said sustain block bore is at least 0.156 inches in diameter.

11. The guitar bridge of claim 1, wherein said post-shape saddle is a Tun-O-Matic style saddle.

12. The guitar bridge of claim 1, wherein said saddle holder has a saddle holding slot and a set screw aperture receiving a set screw, said set screw is threadably positionable to hold said post-shaped saddle in place within said saddle holding slot.

13. The guitar bridge of claim 1, wherein said saddle holder is a tremolo style bridge.

14. A bridge for a six string instrument, comprising:

a bridge plate having six slotted apertures formed therein;

six saddle holders positioned above an upper surface of said bridge plate;

six post-shaped saddles, each of said six post-shaped saddles support by a corresponding saddle holder;

a sustain block having six bores formed therethrough, said sustain block joined to said bridge plate in a position that aligns each of said six bores with a corresponding said slotted aperture; and wherein said bridge is configured to support six strings such that each string anchor passes through a corresponding bore of said sustain block and rest against said bridge plate without the guitar string contacting any surface of said bridge plate or said corresponding saddle holder.

15. A method of manufacturing a guitar bridge, comprising:

forming a slot-shaped aperture in a bridge plate;

forming a saddle holding slot in a saddle holder, wherein the saddle holding slot has is sized and shaped to hold a post-shaped saddle attaching the saddle holder to an upper surface of the bridge plate, wherein the;

forming a passage through a sustain block, wherein the passage is sized to pass a string anchor completely therethrough to directly contact an under surface of the bridge plate; and joining the sustain block to the bridge plate in a position that aligns the string anchor with the slot shaped aperture, wherein the slot shaped aperture has a size and orientation that passes a guitar string directly from the string anchor to the saddle without contacting any surface of the bridge plate and without contacting any surface of the saddle holder.

16. The method of claim 15, wherein the slot-shaped aperture has a width of a size that prevents passage of the string anchor through the slot-shaped aperture.

17. The method of claim 15, wherein the passage is positioned to align the string anchor with an end of the slot-shaped aperture that is oriented away from the saddle.

18. The method of claim 15, wherein the saddle is a Tune-O-Matic style saddle, and the saddle holder is a modified saddle of a tremolo style bridge.

19. The method of claim 15, further comprising positioning the post-shaped saddle in the saddle holding slot.

20. The method of claim 15, further comprising forming a set screw aperture in the saddle holder through which a set screw is threaded to hold the saddle in place within the saddle holding slot.

21. The method of claim 20, further comprising positioning the set screw in the set screw aperture.

* * * * *